US006502441B1

(12) United States Patent
Suzuki et al.

(10) Patent No.: US 6,502,441 B1
(45) Date of Patent: Jan. 7, 2003

(54) METHOD OF BEVELING PLATE-LIKE METAL MEMBER

(75) Inventors: Tetsuo Suzuki, Sayama (JP); Hideki Shigematsu, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 202 days.

(21) Appl. No.: 09/640,367

(22) Filed: Aug. 17, 2000

(30) Foreign Application Priority Data

Oct. 27, 1999 (JP) ..... 11-305194

(51) Int. Cl.[7] ..... B24B 1/00; B24C 1/04

(52) U.S. Cl. ..... 72/53; 29/90.7; 451/38; 451/39; 451/40

(58) Field of Search ..... 29/90.7; 72/53; 451/38, 39, 40

(56) References Cited

U.S. PATENT DOCUMENTS 3,719,009 A * 3/1973 Thompson ..... 451/38
3,820,419 A * 6/1974 McLagan ..... 29/90.7
4,135,283 A * 1/1979 Kohlhage ..... 72/53
4,658,683 A 4/1987 Phillips
4,753,051 A 6/1988 Tano
4,794,741 A 1/1989 Van Dijk
5,249,485 A * 10/1993 Hayden, Sr. ..... 72/53
5,810,644 A * 9/1998 Schmidt ..... 451/38
6,099,391 A * 8/2000 Suzuki et al. ..... 29/90.7
6,315,646 B1 * 11/2001 Hoyashita ..... 29/90.7

FOREIGN PATENT DOCUMENTS

DE 4213186 A 10/1993
JP 11151671 A 9/1999

* cited by examiner

*Primary Examiner*—David Jones
(74) *Attorney, Agent, or Firm*—Birch, Stewart, Kolasch & Birch, LLP

(57) ABSTRACT

A blanked plate-like metal member for use as an element of a belt in a continuously variable transmission has an recess including an undercut therein. A stream of a liquid mixed with particle members is ejected toward an edge to be beveled of the recess thereby to bevel the recess. After the edge is beveled by deburring the edge, the recess is finished by removing a bulge formed on an outer surface of the edge by deburring the edge.

8 Claims, 5 Drawing Sheets

METHOD OF BEVELING PLATE-LIKE METAL MEMBER

BACKGROUND OF THE INVENTION

1. Field of the Invention

The present invention relates to a method of beveling a plate-like metal member.

2. Description of the Related Art

Plate-like metal members to be beveled include elements of a belt for use in continuously variable transmissions, for example. As shown in FIG. 5 of the accompanying drawings, an element 1 of such a transmission belt comprises a body 2 for contacting a pulley of a continuously variable transmission (not shown), and a head 4 joined to the body 2 by a narrow neck 3. The element 1 is blanked out of a metal plate (not shown). The body 2 has a pair of symmetrical saddles 5, and the head 4 has a pair of ears 6 spaced respectively, from the saddles 5 with gaps therebetween. The element 1 includes undercuts 3*d* defined at upper and lower ends of the neck 3. A pair of laminated rings 8 each comprising a stack of metal sheet rings 7 is held in engagement with the respective saddles 5. Although not shown, the transmission belt comprises an annular array of stacked elements 1 that are held together in an annular shape by the laminated rings 8.

If the neck 3 of the element 1 has sharp edge corners 3*a* or is burred at edge corners 3*a* when the element 1 is blanked, then the metal sheet rings 7 tend to be damaged by contact with the neck 3. To avoid such damage, it has been customary to deburr and bevel the edge corners 3*a* of the neck 3.

It is known in the art that, as shown in FIG. 6 of the accompanying drawings, a rotating grinding belt 60 is held in sliding contact with the edge corners 3*a* of the neck 3 of the element 1 to deburr and bevel the edge corners 3*a* of the neck 3.

According to the known process, each element 1 is supported on a rotary disk 61, and rotated thereby while the edge corners 3*a* of the neck 3 are being held against the grinding belt 60. As shown in FIG. 7(*a*) of the accompanying drawings, the grinding belt 60 passes between an upper edge 5*a* of one of the saddles 5 and a lower edge 6*a* of the corresponding ear 6 into abutment against the neck 3. Therefore, the width of the grinding belt 60 is of such dimension that it can pass between the upper edge 5*a* of the saddle 5 and the lower edge 6*a* of the ear 6.

However, if the upper edge 5*a* of the saddle 5 is slightly arcuate in shape, then the distance e between the crest of the upper edge 5*a* of the saddle 5 and the lower edge 6*a* of the ear 6 is relatively small, and a range f of the neck 3 which is beveled by the grinding belt 60 having passed through the distance e is smaller than a range g of the neck 3 which is held in contact with the metal sheet rings 7 of the laminated ring 8. Specifically, the rings 7 of the laminated ring 8 engaging the saddle 5 slide along an extension h (see FIGS. 7(*a*) and 7(*b*)) of the upper edge 5*a* of the saddle 5 into abutting engagement with the neck 3, as shown in FIG. 7(*b*) of the accompanying drawings. At this time, a lower one of the rings 7 abuts against a range i outside of the beveled range f. Therefore, the conventional beveling process using the grinding belt 60 fails to bevel the entire range g of the neck 3 which is contacted by the laminated ring 8. As a result, the rings 7 are not fully protected against damage because they tend to contact the range i of the neck 3 where burrs and sharp edge corners remain unremoved.

According to the conventional beveling process using the grinding belt 60, furthermore, as shown in FIG. 6, the elements 1 supported on the rotary disk 61 are beveled one by one. Consequently, a large number of elements 1 are beveled with poor efficiency in a prolonged period of time.

SUMMARY OF THE INVENTION

It is therefore an object of the present invention to provide a method of beveling a plate-like metal member at a predetermined position thereof reliably and efficiently.

According to the present invention, there is provided a method of beveling a blanked plate-like metal member having an recess including an undercut therein, comprising the step of ejecting a stream of a liquid mixed with particle members toward an edge to be beveled of the recess thereby to bevel the recess.

When the stream of the liquid mixed with particle members is ejected toward the edge to be beveled of the recess including the undercut, the particle members collide with the edge to be beveled, polishing, removing burrs from, and beveling the edge of the recess.

The particle members have such directivity that they collide accurately with the recess in the plate-like metal member. Therefore, the recess can reliably be beveled even if it is located in a relatively narrow region. When the particle members collide with the edge to be beveled, they impart a residual stress in the edge, thereby increasing the mechanical strength of the edge.

The plate-like metal member may comprise an element of a belt for use in a continuously variable transmission. A plurality of such elements are stacked in an annular form and held together by sheet rings, providing the transmission belt. The element comprises a body for contacting a pulley of the continuously variable transmission, and a head joined to the body by a narrow neck, the body having a saddle engageable by the sheet rings, the head having an ear spaced from the saddle with a gap therebetween. The recess is defined by an upper edge of the saddle, a side edge of the neck, and a lower edge of the ear. The stream is ejected toward the edge to be beveled which extends in a range between a point of intersection between the side edge of the neck and an extension of the lower edge of the ear and a point of intersection between the side edge of the neck and an extension of the upper edge of the saddle.

Since the particle members are ejected with directivity, they can collide accurately with a point of intersection between the side edge of the neck and the extension of the upper edge of the saddle. The particle members can therefore reliably deburr and bevel the edge to be beveled which extends in the range between the point of intersection between the side edge of the neck and the extension of the lower edge of the ear and the point of intersection between the side edge of the neck and the extension of the upper edge of the saddle, which range would be contacted by the sheet rings on the side edge of the neck. Therefore, the sheet rings are reliably prevented from damage by contact with the neck. Furthermore, because the mechanical strength of the neck is increased by the residual stress that has been developed in the neck by the impinging particle members, the neck is further protected against damage by contact with the neck.

After the edge is deburred thereby to bevel the recess, the recess is finished by removing a bulge formed on an outer surface of the edge by deburring the edge. Therefore, the recess is given a highly accurate beveled shape. The recess may be finished by barrel polishing.

A stack of the plate-like metal members may be moved in a direction along the stack while recesses in the plate-like metal members are being exposed to one side, and the stream may be ejected toward edges to be beveled of the recesses thereby to bevel the recesses. Therefore, many plate-like metal members can be beveled simultaneously with increased efficiency. If the plate-like metal members comprise elements of a belt for use in a continuously variable transmission, then the stack of elements may be moved in a direction of the stack, and the stream may be ejected toward edges to be beveled of the recesses thereby to bevel the recesses. Consequently, may elements can be beveled simultaneously with increased efficiency.

At this time, the stream may be ejected toward edges to be beveled on one diagonal line of the neck of a stack of the elements to bevel the edges while moving the stack of elements in a direction along the stack, then the stack of elements may be turned 180° about an axis along the direction, and the stream may be ejected toward edges to be beveled on the other diagonal line of the neck of the stack of the elements to bevel the edges while moving the stack of elements in the direction along the stack. In this fashion, the four edge corners of a pair of recesses defined in each element can efficiently be beveled.

The particle members may be made of a material selected from the group consisting of glass, alumina, steel, cast iron powder, and zirconia. The particle members made of the above material are mixed with the liquid, and the stream of the liquid is ejected to the edge to be beveled. Since the particle members collide accurately with the edge to be beveled because of the directivity they have, the edge can be beveled well.

The particle members may be crushed upon collision with the edge to be beveled. The particle member that can be crushed upon collision with the edge to be beveled may comprise glass beads. The glass beads are broken by the impact at the time they collide with the edge. The fragments of the glass beads thus broken are pressed again against the edge by the stream of the liquid for reliably and efficiently beveling the edge.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

FIG. 4(*b*) is a fragmentary cross-sectional view of the edge corner of the neck as it is beveled;

FIG. 4(*c*) is a fragmentary cross-sectional view of the edge corner of the neck as it is finished;

FIG. 7(*b*) is a fragmentary view showing the portion of the element shown in FIG. 7 that is poorly beveled and tends to damage a laminated ring.

DESCRIPTION OF THE PREFERRED EMBODIMENT

Figure 5:
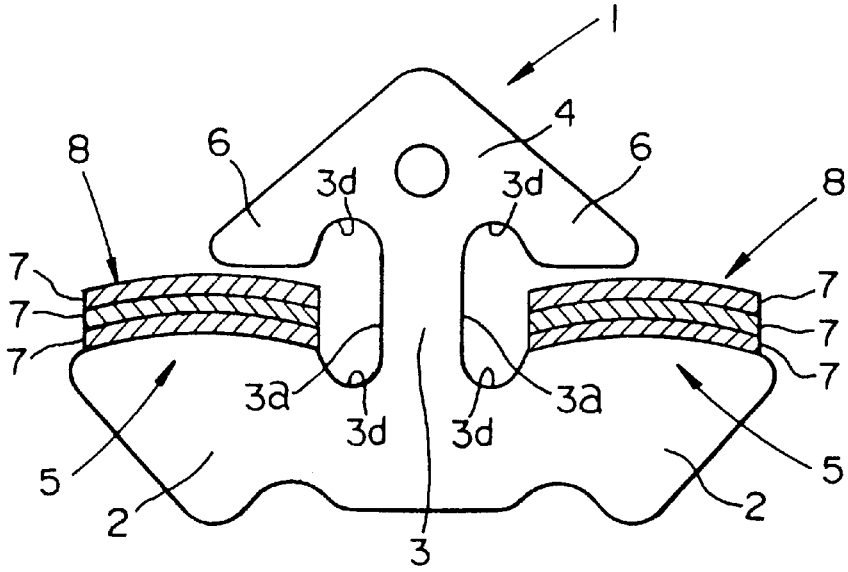
FIG. 5 is a front elevational view of an element.
Figure 6:
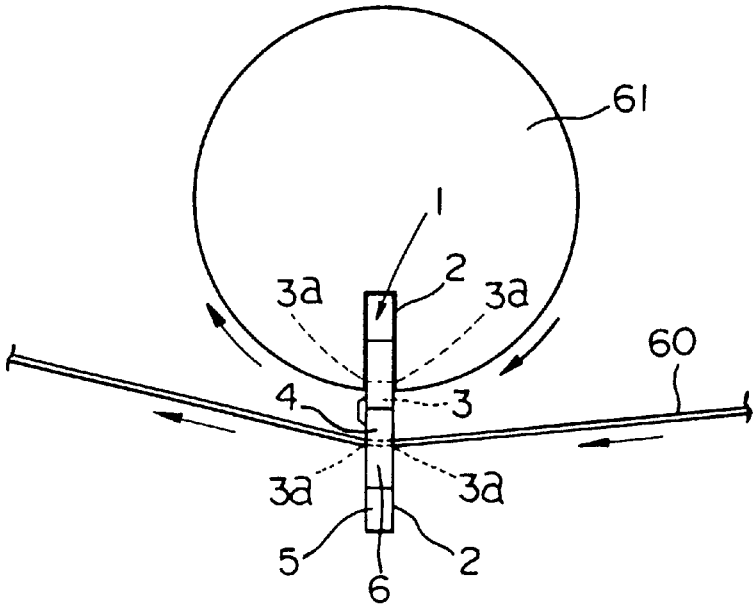
FIG. 6 is a schematic view of an apparatus used to carry out a conventional method of beveling a plate-like metal member.
Figure 7:
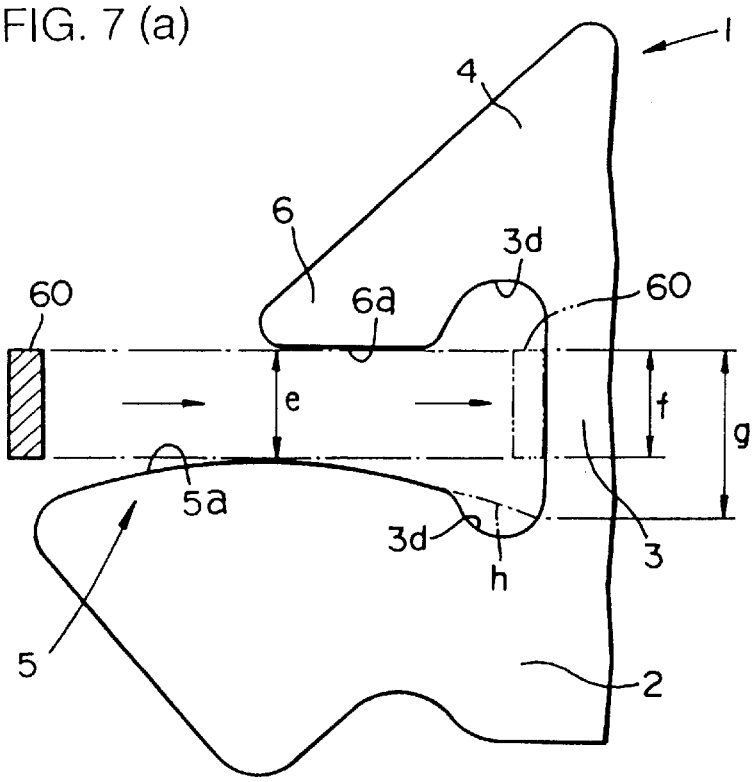
FIG. 7(*a*) is a fragmentary view showing a portion of the element shown in FIG. 6 which is beveled by the conventional method.
Figure 7:
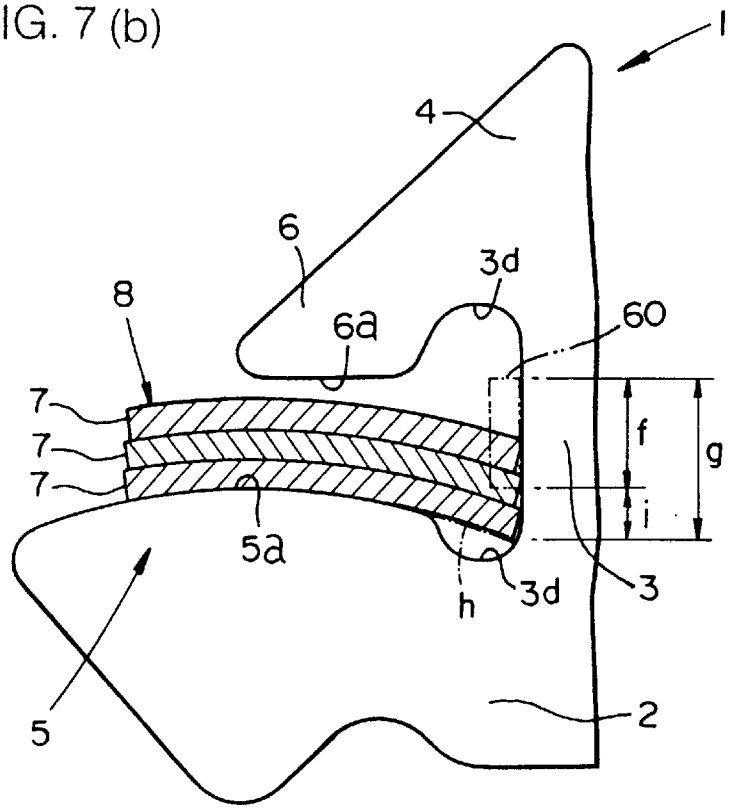

An element 1 of a belt for use in continuously variable transmissions, as a plate-like metal member to be beveled, will first be briefly described below with reference to FIG. 5. The element 1 is blanked out of a metal plate, and comprises a body 2 and a head 4 joined to the body 2 by a narrow neck 3. The body 2 has a pair of symmetrical saddles 5, and the head 4 has a pair of ears 6 spaced respectively from the saddles 5 with gaps therebetween. The element 1 includes undercuts 3*d* defined at upper and lower ends of the neck 3. The transmission belt comprises an annular array of stacked elements 1 that are held together in an annular shape by a pair of laminated rings 8 each comprising a stack of metal sheet rings 7. The laminated rings 8 are held in engagement with the respective saddles 5.

Figure 1:
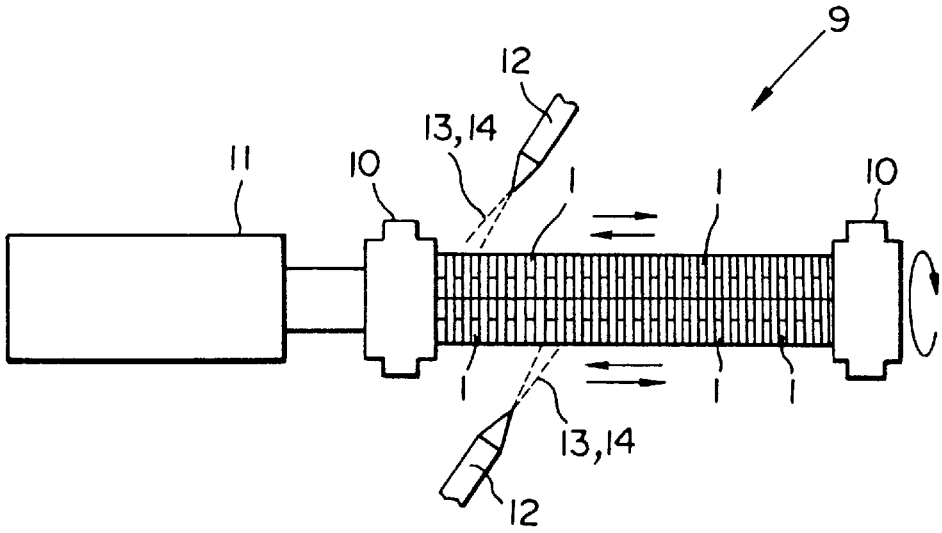
FIG. 1 is a schematic view of an apparatus used to carry out a method of beveling a plate-like metal member according to the present invention.
Figure 2:
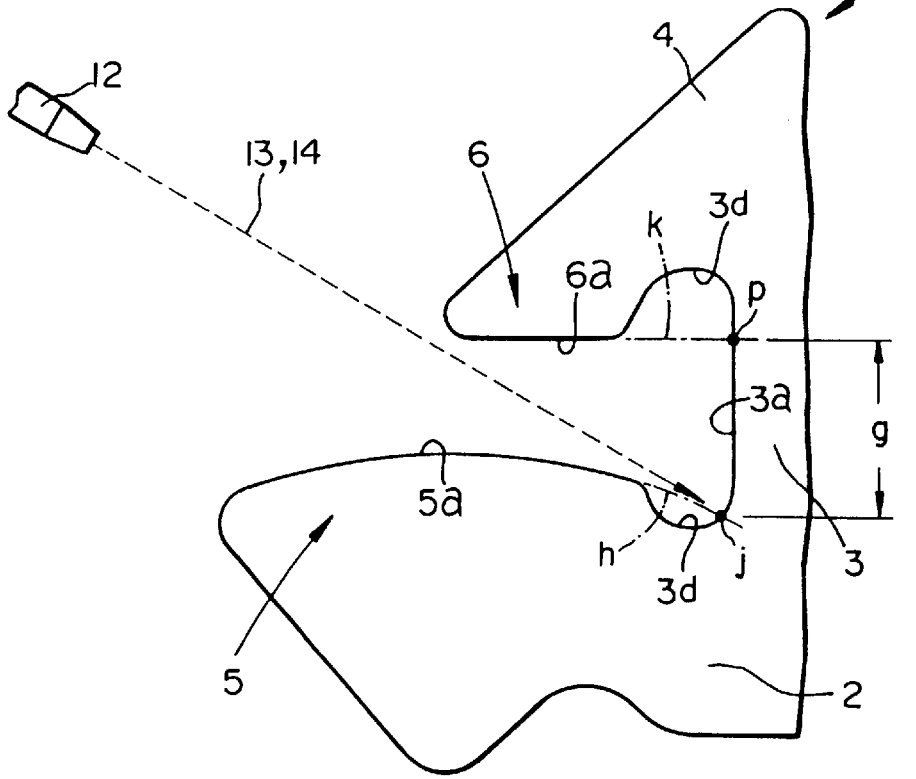
FIG. 2 is a fragmentary view showing a portion of an element as a plate-like metal member to be beveled by the method according to the present invention.
Figure 3:
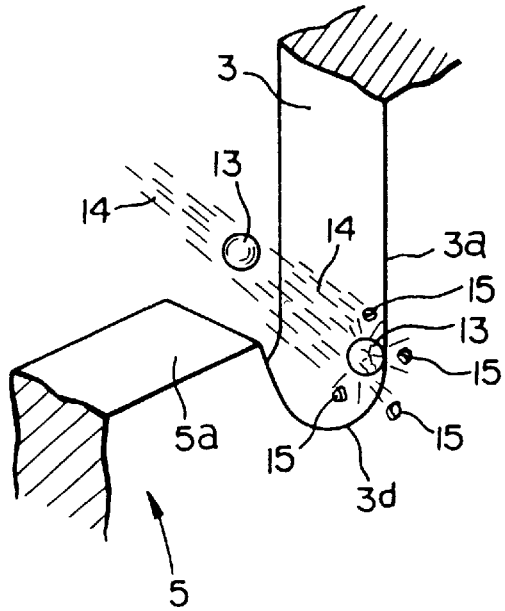
FIG. 3 is an enlarged fragmentary perspective view, partly broken away, of an edge of a neck of the element shown in FIG. 2.

According to the illustrated embodiment of the present invention, the neck 3 of the element 1 is beveled. FIG. 1 shows a beveling apparatus 9 used to carry out a method of beveling a plate-like metal member according to the present invention. The beveling apparatus 9 comprises a rotatable holding means 10 for holding a stack of elements 1 and a rotating means 11 for rotating the holding means 10. The holding means 10 is movable back and forth in the direction along which the elements 1 are stacked, by a displacing means (not shown). The beveling apparatus 9 includes a pair of ejection nozzles 12 disposed one on each side of the holding means 10. As shown in FIGS. 2 and 3, each of the ejection nozzles 12 ejects a stream of water 14 mixed with glass beads 13 as particle members toward the neck 3 of the element 1 that is held by the holding means 10. As shown in FIG. 1, each of the ejection nozzles 12 is inclined to the neck 3 of each of the stacked elements 1.

For beveling the neck 3 of the element 1 with the beveling apparatus 9, a stack of elements 1 are held by the holding means 10, as shown in FIG. 1. Then, the stream of water 14 mixed with glass beads 13 are ejected from each of the ejection nozzles 12 toward the neck 3 of each of the elements 1, while at the same time the holding means 10 is moved in the stacked direction of the elements 1 by the displacing means. In this manner, the elements 1 held by the holding means 10 are deburred and beveled in a relatively short period of time.

Since the glass beads 13 ejected from each of the ejection nozzles 12 have directivity, the glass beads 13 can be oriented to pass accurately between the ear 6 and the saddle 5 of the element 1 and applied accurately to an edge corner 3*a* of the neck 3, as shown in FIG. 2. Furthermore, the glass beads 13 can be applied accurately to a region of the neck 3 with which the rings 7 of the laminated ring 8 engaging the saddle 5 possibly slide along the extension h of the upper edge 5*a* of the saddle 5 into abutting engagement, i.e., a point j of intersection between the edge corner 3*a* of the neck 3 and the extension h of the upper edge 5*a,* as shown in FIG. 2.

More specifically, as shown in FIG. 3, the stream of water 14 and the glass beads 13 ejected from the ejection nozzles (see FIG. 1) collide with the edge corner 3*a* of the neck 3, and fragments 15 of the glass beads 13 which are broken upon collision are pressed again against the edge corner 3*a* of the neck 3 by the stream of water 14. In the illustrated embodiment, the glass beads 13 have a diameter of 0.1 mm, and the stream of water 14 is ejected under a pressure of about 200 Mpa. The elements 1 are moved at a speed of 500 mm/min. by the displacing means, and the distance from the ejection nozzle 12 to the edge corner 3*a* of the neck 3 is 50 mm.

Figure 4A:
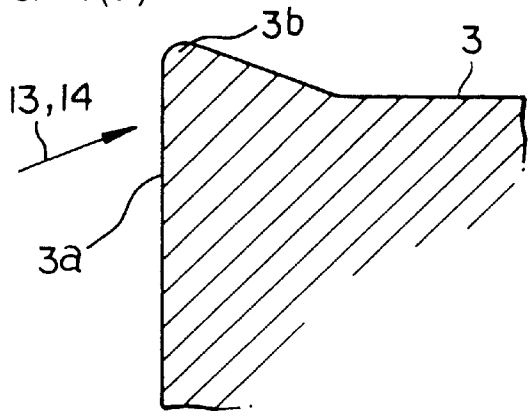
FIG. 4(*a*) is a fragmentary cross-sectional view of an edge corner of the neck.
Figure 4B:
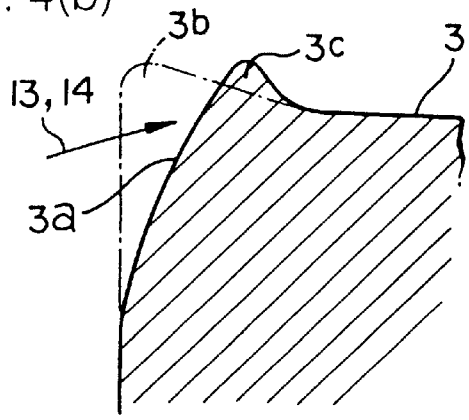
Figure 4C:
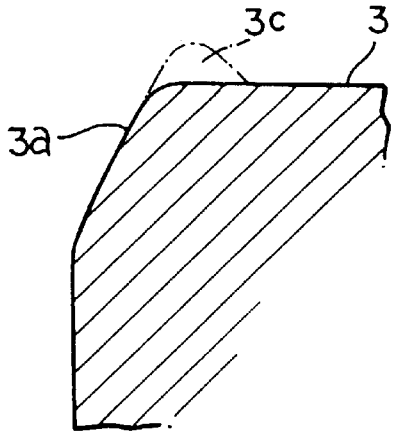

As a result, a burr 3*b* (see FIG. 4(*a*)) on the edge corner 3*a* of the neck 3 is ground off by the glass beads 13 and their fragments 15, as shown in FIG. 4(*b*), thus beveling the edge corner 3*a* of the neck 3 leaving a small bulge 3*c* on the surface of the neck 3. Since a residual stress is developed in the edge corner 3*a* of the neck 3 thus beveled by collision with the glass beads 13, a beveled surface of high mechanical strength is produced on the edge corner 3*a* of the neck 3.

As shown in FIG. 2, each of the ejection nozzles 12 faces a point p of intersection between the edge corner 3*a* of the neck 3 and an extension k of the lower edge 6*a* of the ear 6. Since the ejection nozzle 12 can apply the glass beads accurately to the point p of intersection, the edge corner 3*a* of the neck 3 can be deburred and beveled in a relatively wide range g between the points j, p of intersection.

As shown in FIG. 1, the ejection nozzles 12 are oriented to face the respective edge corners 3*a* on one diagonal line of the neck 3 of each of the stacked elements 1 held by the holding means 10. After the edge corners 3*a* on one diagonal line of the neck 3 have been beveled by the respective ejection nozzles 12, the elements 1 are turned 180° about the axis of the stack by the rotating means 11 through the holding means 10 to bring the edge corners 3*a* on the other diagonal line of the neck 3 into facing relationship to the respective ejection nozzles 12. The edge corners 3*a* on the other diagonal line of the neck 3 can now be beveled by the respective ejection nozzles 12.

After the edge corners 3*a* of the necks 3 of the elements 1 are beveled, the elements 1 are detached from the holding means 10. The elements 1 are then finished by barrel polishing. As a consequence, the elements 1 from which the bulge 3*c* has been removed from the surface of the neck 3 and which are hence highly accurate in dimensions are produced.

In the illustrated embodiment, the glass beads 13 are employed as particle members. However, particle members may be made of alumina, steel, cast iron powder, ceramics such as zirconia, etc.

The method according to the present invention been described as being applied to beveling elements of belts for use in continuously variable transmissions. However, the method according to the present invention is also applicable to beveling other plate-like metal members having recesses defined by edges that need to be beveled.

Although a certain preferred embodiment of the present invention has been shown and described in detail, it should be understood that various changes and modifications may be made therein without departing from the scope of the appended claims.

What is claimed is:

1. A method of beveling a blanked plate-like metal member having a recess including an undercut therein, comprising the steps of:

ejecting a stream of a liquid mixed with particle members toward an edge to be beveled of the recess thereby to bevel the recess;

deburring said edge thereby to bevel the recess; and thereafter, finishing said recess by removing a bulge formed on an outer surface of said edge by deburring said edge.

2. A method according to claim 1, wherein said recess is finished by barrel polishing.

3. A method according to claim 1, further comprising the steps of:

moving a stack of said plate-like metal members in a direction along said stack while recesses in said plate-like metal members are being exposed to one side; and ejecting said stream toward edges to be beveled of the recesses thereby to bevel the recesses.

4. A method according to claim 1, wherein said plate-like metal member comprises an element of a belt for use in a continuously variable transmission, said element being engageable by sheet rings, said element comprising a body for contacting a pulley of the continuously variable transmission, and a head joined to said body by a narrow neck, said body having a saddle engageable by said sheet rings, said head having an ear spaced from said saddle with a gap therebetween, said recess being defined by an upper edge of said saddle, a side edge of said neck, and a lower edge of said ear, said method further comprising the step of:

ejecting said stream toward said edge to be beveled which extends in a range between a point of intersection between said side edge of the neck and an extension of the lower edge of said ear and a point of intersection between said side edge of the neck and an extension of the upper edge of said saddle.

5. A method according to claim 4, further comprising the steps of:

moving a stack of said elements in a direction along said stack while recesses in said elements are being exposed to one side; and ejecting said stream toward edges to be beveled of the recesses thereby to bevel the recesses.

6. A method according to claim 4, further comprising the steps of:

ejecting said stream toward edges to be beveled on one diagonal line of the neck of a stack of said elements to bevel said edges while moving said stack of elements in a direction along said stack;

turning said stack of elements 180° about an axis along said direction; and ejecting said stream toward edges to be beveled on the other diagonal line of the neck of said stack of said elements to bevel said edges while moving said stack of elements in said direction along said stack.

7. A method according to claim 1, wherein said particle members are made of a material selected from the group consisting of glass, alumina, steel, cast iron powder, and zirconia.

8. A method according to claim 1, wherein said particle members are crushed upon collision with said edge to be beveled.

* * * * *